United States Patent [19]

Dittrich et al.

[11] 4,019,875

[45] Apr. 26, 1977

[54] ALUMINUM-COATED NICKEL OR COBALT CORE FLAME SPRAY MATERIALS

[75] Inventors: Ferdinand J. Dittrich, Massapequa; George J. Durmann, Farmingdale; Herbert S. Ingham, Jr., Northport, all of N.Y.

[73] Assignee: Metco, Inc., Westbury, N.Y.

[22] Filed: June 13, 1975

[21] Appl. No.: 586,784

Related U.S. Application Data

[63] Continuation-in-part of Ser. No. 377,152, July 6, 1973, abandoned.

[52] U.S. Cl. ..... 428/570; 428/678; 428/679; 75/255; 427/423; 75/252; 75/.5 B

[51] Int. Cl.[2] ..... B23P 3/00; B21C 37/00; B05B 7/20

[58] Field of Search ..... 29/192 CP, 197, 194, 29/196.6, 195 P, 195 L, 191.2; 75/170, 171, .5 B, .5 BA; 427/423

[56] References Cited

UNITED STATES PATENTS

| | | | |
|---|---|---|---|
| 2,936,229 | 5/1960 | Shepard | 75/.5 AA |
| 3,254,970 | 6/1966 | Dittrich et al. | 75/170 |
| 3,322,515 | 5/1967 | Dittrich et al. | 29/191.2 |
| 3,436,248 | 4/1969 | Dittrich et al. | 427/423 |

*Primary Examiner*—Walter R. Satterfield
*Attorney, Agent, or Firm*—Burgess, Dinklage & Sprung

[57] ABSTRACT

A flame spray material in the form of a composite comprising (1) as a first component an alloy containing at least about 40% of its weight of at least one of nickel and cobalt, and about 1 to 6% by weight of boron, and (2) aluminum powder as a second component, the first component being present in about 66 to 99% by weight of the composite. The material, desirably blended with about 10% of an aluminum-molybdenum-coated nickel core powder, produces self-bonded wear resistant coatings which can be ground without cracking.

26 Claims, No Drawings

ALUMINUM-COATED NICKEL OR COBALT CORE FLAME SPRAY MATERIALS

CROSS-REFERENCE TO RELATED APPLICATION

This is a continuation-in-part of copending application Ser. No. 377,152 of July 6, 1973 and now abandoned.

BACKGROUND OF THE INVENTION

The invention relates to an aluminum-clad nickel-cobalt-boron based flame spray material which is characterized by excellent bonding and workability of coated surfaces.

It is common to line metal surfaces with other metals of different mechanically superior properties to obtain the best properties of both metals, e.g. cylinders in aluminum engine blocks have been lined with iron sheets to give the benefits of the light weight of aluminum and the wear properties of iron. An improvement thereon involved flame spraying the wear surface onto the receiving surface. To ensure a secure bond between substrate and sprayed metal, it was customary to prepare the substrate by mechanical roughening. U.S. Pat. Nos. 2,588,421 and 2,588,422 made a further improvement thereon in that molybdenum was first flame sprayed onto the substrate without need for special preparation of the substrate. Thereafter a hard wear surface such as high carbon steel could be sprayed and the laminate would be securely held together.

In U.S. Pat. No. 2,875,043 there were disclosed spray-weld alloys, also known as self-fluxing alloys, comprising nickel bases which could be sprayed and which, because of a content of boron and/or silicon, act as a fluxer of the alloy and of the surface to be alloyed during subsequent fusing of a sprayed coating. Other metallic components such as chromium, iron, carbon, copper and molybdenum could also be present. In U.S. Pat. No. 2,936,229 it was taught that such self-fluxing alloys might also contain about 0.2 to 5% of aluminum and that the nickel could be replaced in whole or in part by cobalt. These modifications minimized the formation of any small pores in the coating. Other elements could also be present in minor amounts.

For certain purposes it was desired that the flame sprayed surface constitute an intermetallic compound. In U.S. Pat. No. 3,305,326 there was disclosed a powder mixture as described in U.S. Pat. Nos. 2,875,043 and 2,936,229 along with coated powder particles comprising a metal nucleus and a metal coating reactable therewith at flame spray temperatures to form an intermetallic compound. The coated powder material rendered the blend self fusing, i.e. it automatically formed a fused coating upon spraying without a separate fusing operation. In U.S. Pat. No. 3,322,515 there were described modified flame spray composite materials whose components exothermically interacted with one another when melted so as to form such intermetalic compound which was deposited upon the substrate. The heat generated by the exothermic reaction aided in the bonding, and these materials were an improvement over molybdenum for bonding other flame spray materials to the substrate. The composite could comprise separate strands of the two components, e.g. a strand of nickel and a strand of aluminum, the strands being simultaneously fed to a flame spray gun. In accordance with a preferred technique one of the components could be coated onto the other, e.g. a wire comprising a nickel core and an aluminum sheath.

These composites functioned in generally satisfactory fashion but had certain significant limitations. For example the self-fusing mixture of U.S. Pat. No. 3,305,326 did not bond very well, and required either a special substrate preparation such as roughening by grit blasting, or a preliminary layer of a bonding material such as molybdenum or exothermic composite described above.

The surfaces, while of adequate bond strength for most purposes, still imposed limitations upon the working to which the coated surfaces could be put.

It is accordingly an object of the present invention to provide flame sprayable compositions which are self-bonding and which produce coatings which may readily be worked without de-bonding.

A further object of the invention is to produce superior flame sprayed bearing surfaces.

SUMMARY OF THE INVENTION

These and other objects and advantages are realized in accordance with the present invention pursuant to which there is provided a flame spray material in the form of a composite comprising (1) as a first component an alloy containing at least about 40% of its weight of at least one of nickel and cobalt, and about 1 to 6% by weight of boron and (2) aluminum powder as a second component, the first component being present in about 66 to 99% by weight of the composite. The resulting coatings are characterized by excellent bonding and superior bearing and wearing surfaces. They can readily be worked, generally by grinding.

In one form of the invention there is contemplated a flame spray powder material in the form of a composite suitable for flame spraying, formed of at least two metal components which react exothermically with each other when melted to form an intermediate compound, the material comprising: 1. A first core powder component, which core component consists essentially of a self-fluxing alloy which in turn consists essentially of at least about 40% of its weight of nickel or cobalt and about 1 to 6% by weight boron, and 2. A coating component of fine aluminum powder on said core, which powder coating is held to said core by a binder, the core component being present in an amount about 66 to 99% of the combined weight of the first and second components, said composite being in the form of a structurally integral unit where each particle of the core component has bonded thereto the coating component.

The first component, which preferably constitutes about 66 to 99% and most preferably about 85 to 97%, e.g., 85 to 95%, of the combined weights of the first and second components, may comprise any of the spray-weld, self-fluxing alloy compositions disclosed in above-mentioned U.S. Pat. Nos. 2,875,043 and 2,936,229, the disclosures of which are incorporated herein by reference. Thus, the first component may further contain up to 6% of its weight of silicon, e.g., 1–6% by weight silicon, preferably about 2 to 5%, e.g., 4 to 5%; up to about 20% and preferably 8 to 20% of chromium; up to about 8%, and generally at least about 3% when present, of copper, preferably about 5 to 6%; up to about 10%, and generally at least about 3% when present, of molybdenum, preferably about 4.5 to 5.5%; and aluminum desirably up to 5% and preferably up to about 2%. Iron up to 8% and preferably up to 5%, carbon up to 2% and preferably up to 1.5%, and tungsten up to 20% and preferably up to 10%, may also be present. While the nickel and/or cobalt should constitute at least about 40% of the first component as described, advantageously it should constitute at least about 60%. The boron is 1 to 6% and preferably 1.5–5%.

As the first component there is employed a core of a self-fluxing alloy. This self-fluxing alloy contains nickel or cobalt and boron together with other materials as indicated above. In the table set forth below, there is indicated various ranges of components of the self-fluxing alloy in their relative amounts.

TABLE I

COMPOSITION OF SELF-FLUXING ALLOY CORE COMPONENT

| Component | ← In Weight Percent → Broad Range | Preferred Range | Highly Preferred Range |
|---|---|---|---|
| Nickel or Cobalt | 40–99 | 60–82 | 67.6–78 |
| Boron | 1–6 | 1.5–5 | 1.5–2.5 |
| Silicon | 0–6 | 2–5 | 2–3.5 |
| Chromium | 0–20 | 8–20 | 9–11 |
| Copper | 0–8 | 3–8 | 5–6 |
| Molybdenum | 0–10 | 3–10 | 4.5–5.5 |
| Aluminum | 0–5 | 0–2 | 0 |
| Iron | 0–8 | 0–5 | 0–3 |
| Carbon | 0–2 | 0–1.5 | 0–0.7 |
| Tungsten | 0–20 | 0–10 | 0 |
| Balance of Other Material | 0–1 | 0–0.5 | 0–0.2 |

The second component, as noted, comprises aluminum, and preferably it is employed as a fine powder deposited in a binder on particles of the first component.

The coating component can contain other materials. Generally, the coating component, i.e., the second component, has a composition within the following ranges:

TABLE II

COMPOSITION OF COATING COMPONENT

| Component | ← In Weight Percent → Broad Range | Preferred Range | | Highly Preferred Range |
|---|---|---|---|---|
| Aluminum | 1–34 | 3–15 | | 5–10 |
| Silicon | 0–10 | 0–10 | | 0–10 |
| Molybdenum | 0–16 | 0–10 | (if present) | 5–10 |
| Boron | 0–3 | 0–2 | (if present) | 0.1–2 |
| Iron | 0–20 | 0–15 | | 0–12 |

The thickness of the coating can vary considerably. Generally, it is between 0 and 50 microns, preferably between 1 and 25 microns thick. To some extent, the thickness will depend upon the size of the coating component powder and whether there is complete coverage.

The aluminum including other cladding components, preferably in as finely divided form as possible, generally from 1 micron to 325 mesh, for example −325 mesh and preferably −25 microns, is mixed in the required proportions with a binder of lacquer so as, in effect, to form a paint in which the aluminum particles correspond to the pigment. The paint is then used to coat the core particles and allowed to set or dry.

The binder material may be any known or conventional binder material which may be used for forming a coating or for bonding particles together or to a surface. The binder is preferably a varnish containing a resin as the varnish solids, and may contain a resin which does not depend on solvent evaporation in order to form a dried or set film. The varnish may thus contain a catalyzed resin as the varnish solids. Examples of binders which may be used include the conventional phenolic epoxy or alkyd varnishes, varnishes containing drying oils, such as tuna oil and linseed oil, rubber and latex binders and the like.

The coating of the high nickel-cobalt first or core component with the "paint" containing the aluminum may be effected in any known or desired manner, and it is simply necessary to mix the two materials together and allow the binder to set or dry which will result in a fairly free-flowing powder consisting of the nickel-cobalt core coated with cladding of the aluminum.

The powders are sprayed in the conventional manner using a powder type flame spray gun, though it is also possible to combine the same in the form of a wire or rod, using plastic or a similar binding, as for example polyethylene which decomposes in a heating zone of the gun. When formed as wires, the same may have conventional sizes and accuracy tolerances for flame spray wires and thus, for example, may vary in size between ¼inch and 20 gauge.

The spraying is in all respects effected in the conventional manner previously utilized for self-bonding flame spray material, and in particular nickel aluminum composites. Due to the self-bonding characteristics, special surface preparation other than a good cleaning is not required though, of course, conventional surface preparation may be utilized if desired. The powder in accordance with the invention may be flame-sprayed as a bonding coat for subsequently applied flame spray material. The composites may furthermore be sprayed in conjunction with, or in addition to, other flame spray materials conventionally used in the art.

When sprayed, the nickel and/or cobalt and aluminum are believed to react exothermically, forming a nickel and/or cobalt aluminide intermetallic. Complex aluminides and alloys with other metals, when present, may be formed.

The term "composite" as used herein is intended to designate a structurally integral unit and does not include a mere mixture of components which may be physically separated without any destruction of the structure. Thus, in the case of powder, the term "composite" does not include a simple mixture of individual granules of the separate components, but requires that each of the individual granules contain the separate components which will exothermically react, forming intermetallic compounds. In the case of wire, the individual components must be incorporated in a single wire. In the composite the components must be in intimate contact with each other.

In connection with powders, each grain may consist of an aggregate containing the components which will exothermically react, forming the intermetallic compound, but preferably the individual grains of the powder are in the form of a clad composite consisting of a nucleus of one of the components and at least one coating layer of the other components. Alternatively, the composite may consist of separate, concentric coating layers of at least two of the components and a nucleus of two, three or even a fourth material.

In the case of wires, the composites may be in the form of a wire having a coating sheath of one material and a core of the others, alternate coating sheaths of two of the components and a core of the third or a fourth material, a wire formed by twisting or rolling separate wire strands of the components, a wire consisting of a sheath of one component and a core containing the other components in powder or compacted form, a wire consisting of a sheath of one component and a core containing a compacted powder mixture of this same component material and other components, a wire consisting of a plastic sheath and a core containing a compacted powder mixture of components, etc.

In order for the wires to be most satisfactory for spraying, it is preferable that the same must not cavitate at the tip when heated, and should preferably be capable of forming a pointed or slightly tapered tip when being melted and sprayed. Thus, if the wires have an outer layer or sheath of one component and an inner core of another component, the inner core should not have a lower melting point than the outer sheath, as otherwise the inner core will initially melt, causing cavitation at the tip. For example, if the wire is in the form of a core with a coating sheath, the coating sheath should be aluminum, as otherwise during the spraying operation the wire will initially melt out, causing the cavitation which may interfere with a satisfactory spraying operation. The wire having the melting-point characteristics so as to allow the melting off of the tip without this cavitation is referred to herein and in the claims as "non-cavitating wire."

While the components may be present in the stoichiometric proportions required for the formation of the intermetallic compound, it is, however, possible to also have an excess of one or the other provided the relative amounts are sufficient to release quantities of heat in the formation of the intermetallic compounds.

The clad powders, in accordance with the invention, may be formed in any known or desired manner, including known chemical plating processes, in which coating material is deposited on a seed or nucleus of another material, or in which multiple layers of various materials are built up on the seed material, or in which various materials are co-deposited in a single layer on the seed material.

A mode of forming the clad powders involves the depositing of a metal from a solution by reduction on a seed or nucleus, such as by the hydrogen reduction of ammoniacal solutions of nickel and/or cobalt and ammonium sulfate on a seed powder catalyzed such as by the addition of anthraquinone. It is also possible to form the coating by other processes, such as coating by vapor deposition, by the thermal decomposition of metal carbonyls, by hydrogen reduction of metal halide vapors, by thermal deposition of halides, hydrides, carbonyls, organometals, or other volatile compounds, or by displacement gas plating and the like.

A preferred and greatly simplified mode of forming the clad powders in accordance with the invention is the depositing of one component as coating in the form of a paint on the other component. Thus, the component which is to form the coating or cladding may be dispersed in finely divided form in a binder or lacquer so as, in effect, to form a paint in which this component corresponds to the pigment. The paint is then used to coat core particles of the other component and the binder or lacquer allowed to set or dry. The binder material is preferably a resin which does not depend on solvent evaporation in order to form a dried or set film, and which film will decompose or break down in the heat of the spraying process. The binder, for example, may be a phenolic varnish or any other known or conventional varnish, preferably containing a resin as the varnish solids. The components which are initially mixed with the binder or varnish should preferably be as finely divided as possible, as for example −325 mesh. The other component which constitutes the core should be approximately or only slightly below the particle size ultimately desired for the spray powder. The coating of the core component with the "paint" may be effected in any known or desired manner, and it is simply necesssary to mix the two materials together and allow the binder to dry or set, which will result in a fairly free-flowing powder consisting of the core component coated with a cladding of the other component bound in the binder.

The aggregates may be formed by any other known method, such as by compacting or briquetting the various components into the individual granules, or into larger aggregates and then breaking these aggregates into the granules.

The wires may be formed in the known conventional manner for forming wires with various components as, for example, by shrinking a sheath on a core, by forming the core with powder, by twisting the component wires, followed by rolling, drawing, swaging, or the like if desired.

In accordance with one mode of manufacture, one of the components may be formed into a tube or sheath and filled with a powder of the other component or a powder comprising a mixture of the two components, or containing additional components. The tube ends are then sealed and the wire reduced to the desired wire diameter by swaging, rolling or drawing. Preferably the powder or powder mixture is first compressed into cylindrical briquettes before being placed in the sheath or core. The sealing of the tube ends after loading with the powder or powder mixture can be effected, for instance, by insertion of a plug, for example of the metal of the sheath, by welding, twisting, crimping, or the like.

Powders in accordance with the invention should have the general over-all shape and size of conventional, flame spray powders, and thus for example should have a size between −60 mesh and +3 microns and preferably −140 mesh and +10 microns (U.S. Standard screen mesh size). Most preferably the powder should be as uniform as possible in grain size, with the individual grains not varying by more than 250 microns and preferably 75 microns.

Depending on the particular flame spray process and the desired purpose, the composite powder may be sprayed per se or in combination with other different composite powders, or in combination with other conventional flame spray powders or powder components.

While the powders are preferably sprayed, as such, in a powder-type of flame spray gun, it is also possible to combine the same in the form of a wire or rod, using a plastic or similar binder, which decomposes in the heating zone of the gun, or in certain cases the powders may be compacted and/or sintered together in the form of a rod or wire. The wires must have the conventional sizes and accuracy tolerances for flame spray wires and thus, for example, may vary in size between ¼ inch and 20 gauge, and are preferably of the following sizes: 3/16 inch +0.0005 inch to − 0.0025 inch, ⅛ inch + 0.0005 inch to −0.0025 inch, 11 gauge − 0.0005 inch to −0.0025 inch, and 15 gauge + 0.0001 inch with a smooth clean finish free from surface marks, blemishes, or defects. The wires are sprayed in the conventional manner, using conventional wire-type flame spray guns.

In combining, in the exothermic reaction, forming the intermetallic compound, the components generate heat in situ in the actual material which is to form at least a part of the coating. This is to be distinguished from flamespray processes and materials in which heat is generated by a reaction, such as an oxidation reaction in which a foreign and non-metallic element is introduced and in which undesirable components may be produced. Aside from greatly contributing to the thermal efficiency of the process, the heat generated in situ in the formation of the intermetallic compound produces novel results, in many instances forming a denser, more adhering coating, having characteristics of at least a partially fused coating. In many instances the coating has self-bonding characteristics, so that special surface preparation, other than a good cleaning, is not required. The spraying in all other respects is effected in the conventional, well-known manner, using conventional flame spray equipment, and the conventional surface preparation may be utilized, if desired. The composites in accordance with the invention may be sprayed in conjunction with or in addition to other flame spray materials conventionally used in the art, or may be sprayed in combination or conjunction with the others.

The use of the nickel- and/or cobalt- aluminum composites will generally improve the bond of the total sprayed material, and thus of the other component or components, to the substrate, sometimes making the mixture self-bonding. The particle bond will be improved and the coating will be denser, so that its porosity may be decreased. In general, as little as about 5% by weight of the composites in accordance with the invention will be sufficient to substantially improve the bonding characteristics and decrease the porosity of other flame spray materials, such as conventional flame spray metals, alloys or ceramics. There is, of course, no upper limit on the amount as the composite may be sprayed per se.

An especially suitable material is one wherein the aluminum clad self-fluxing alloy is itself blended with a nickel containing material. The blend comprises the novel composite and up to about 20% of its weight, preferably about 5 to 15% of its weight, of another composite generally having a nickel content. The other composite may, in turn, simply be nickel or it can be aluminum clad nickel. Preferably, it is aluminum-and molybdenum-clad nickel as described more fully in U.S. Pat. No. 3,841,901 of Oct. 15, 1974, the disclosure of which is incorporated herein by reference. Generally the material blended with the aluminum clad self-fluxing alloy itself has a composition within the following ranges:

TABLE III

COMPOSITION OF BLEND ADDITIVE

| Component | ← In Weight Percent → Broad Range | Preferred Range |
|---|---|---|
| Nickel | 66–97.5 | 80–92 |
| Aluminum | 2–18 | 4–10 |
| Molybdenum | 0–16 | 4–10 |

In such other composite based on the weight of nickel, aluminum and molybdenum the nickel is present in about 66 to 98%, the aluminum in about 2 to 18 and the molybdenum in up to 16%, e.g., 0.5 to 16%; preferably the nickel is present in about 80 to 92%, e.g., 73 to 89%, the aluminum in about 4 to 10% and the molybdenum in about 4 to 10%. Such other composite, which is preferably a clad core, is generally produced in the same manner as described hereinabove for the composite forming the basis of this invention. Such blends produce coatings which will not crack upon working even when extremely thick, e.g., more than about 0.050 inch and even more than about 0.100 inch.

Materials with which the novel composites may be admixed before flame spraying include carbides as described in U.S. Pat. No. 3,305,326. When blended with a refractory carbide, such as tungsten carbide, titanium carbide, zirconium carbide, tantalum carbide, columbium carbide, hafnium carbide, chromium carbide or the like, extremely high quality coatings are produced, which are superior in various respects to the conventional carbide coatings.

The carbides used in accordance with this embodiment should have a particle size between about −140 mesh U.S. Standard screen size and 8 microns, and preferably between about −270 mesh and +15 microns, with the amount of carbide being between about 5–95% and preferably 25–85% and most preferably 45–55% by weight, based on the total powder mixture.

If the refractory carbide powder is in a form so that the refractory carbide is bound in a matrix, as for example a cobalt or nickel matrix containing 5–20% by weight of either cobalt or nickel, unusually hard and wear-resistant coatings will be produced which do not contain the individual carbide particles imbedded in a fused matrix, but instead contain alloy phases whose micro-hardness is actually substantially higher than that ordinarily obtained from a bonded carbide.

When the powder, in accordance with the invention, containing this matrix-bonded refractory carbide is plasma-sprayed, the same is self-bonding, so that the conventional surface preparation for flame spraying, as for example a deep surface roughening, is not required.

The carbide coatings formed in accordance with the above are extremely hard and wear-resistant, and may be useful as bearing surfaces, abrasive surfaces, and for any other purpose wherein a working surface requires extremely wearresistant coating.

The refractory carbide, need not be matrix-bound, but should be a pure crystalline carbide, also having the particle size and used in the amounts indicated above. The crystalline carbide-containing coatings formed in accordance with the invention will have extremely high wear-resistance due to the carbide particles, which are dispersed and tightly bound in the fused coating. Coatings may be used for the same type of applications as mentioned in connection with the coatings formed with the matrix-bound carbide.

The following examples, wherein all parts are by weight unless otherwise expressed, are given by way of illustration and not limitation.

EXAMPLE 1

Finely divided aluminum powder (−325 mesh) was admixed with a conventional phenolic varnish having approximately 10% solid contents so as to form a mixture having the consistency of heavy syrup and containing about 60% by weight of the metal particles. 100 Grams of the varnish powder mixture was then added to about 900 grams of a self-fluxing alloy powder comprising −200 + 325 mesh particles of the composition 0.15% carbon, 2.5% silicon, 2.5% boron, 2.5% iron, 10% chromium, balance nickel. The two were thoroughly mixed, with the mixing continued until the varnish dried, leaving a fairly free-flowing powder in which all of the core particles were clad with a dry film which contained the aluminum particles. The powder was then warmed to about 250° F. to ensure complete drying. The powder was then screened and hand-milled to reduce the same to a −100 mesh powder. The powder was flame-sprayed on a mild steel plate which had been surface cleaned by smooth grinding. The spraying was effected under different conditions using three different flame spray guns sold by Metco Inc., of Westbury, N.Y., as described in Table IV.

TABLE IV

Spray Parameters for a Self-Bonding Grindable Coating

| METCO "5P" ThermoSpray[1] | METCO "N" ThermoSpray[1] | METCO "3MB"[1][2] Plasma Spray Gun |
|---|---|---|
| Nozzle=P7G | N7B | Gas=$N_2/H_2$ |
| Meter Valve=12 | 15 | Press (psi)=50/50 |
| Clicks=8 | 9 | Flow=100/10 |
| $O_2$ Flow=25 | Press=$O_2$13 | Current=500 AMPS |
| Acet. Flow=40 | Press Acet. 15 | Voltage=73 Volts |
| Carrier=$O_2$ | $O_2$ | Carrier=37 |
| Vibrator | Vibrator | Nozzle=G |
| Spray Dist.=10" | 7" | Port=2 |
| Spray Rate=9 Lbs./Hr. | 6/Hr. | "S" Wheel 20 |
| Deposit Efficiency =75% | 85% | Spray Rate=10 Lbs./Hr. |
| Hardness=Rc 37 | Rc 34 | Spray Distance=6" Hardness=Rc47–49 |

[1]As described in U.S. Patent No. 2,961,335.
[2]As described in U.S. Patent No. 3,145,287.

EXAMPLE 2

When 90% of the composite aluminum clad self-fluxing alloy in Example 1 was admixed (blended) with 10% composite powder of aluminum-molybdenum clad nickel core (Example 1 of U.S. Pat. No. 3,841,901), and sprayed per Example 1, a hard grindable coating was produced which did not crack upon working even when extremely thick. The coating also had a bond strength of 5,260 psi (Table V).

There is set forth below a comparison of the blend of Example 2 comprising the clad material of the invention together with the compositions of U.S. Pat. No. 3,841,901 versus one of the best grindable compositions heretofore available, which composition, however, is not self-bonding.

TABLE V

Properties of a self bonding, grindable coating

| Spray Technique | Feed Setting | Gas Balance | Spray Distance | Bond Strength lbs/sq. in. High | Low[3] | Average | Hardness Rc[4] | Surface Finis $\mu$"AA with 60 grit SiC[5] |
|---|---|---|---|---|---|---|---|---|
| 5P-Material A[1] | 16–18 clicks | $O_2$34/34 acetylene | 6–8" | — | — | — | 23<br>25 | 40–70 |
| 5-P-Self Bonding Grind. Material B[2] | 8 clicks<br>8–9 lbs/hr. | $O_2$25/40 acetylene | 10" | 5634 | 4865 | 5260 | 37 | 10–15<br>9–13 |
| N gun Material A[1] | 9 | $O_2$13 No./15 No. acetylene | 5–7" | — | — | — | 23 | 25–40 |
| N gun Self Bonding[2] | | $O_2$13 No./15 No. acetylene | 7" | 2868 | 2278 | 2700 | 34 | 13–20 |
| Grindable, Material B | 9 | | | | | | | |
| " | 9 | " | 9" | 3034 | 2496 | 2666 | 31 | 8–12 |
| " | 9 | " | 11" | 2765 | 2458 | 2564 | — | — |
| 3MB plasma-Material A[1] | "S"<br>28RPM | G Nozzle<br>No. 1 port<br>$N_2$ 100/15$H_2$ | 4–5 | | | | 33 | |
| 3MB plasma-Self Bonding Grindable, Material B[2] | "S"<br>20RPM | G Nozzle<br>No. 2 port<br>$N_2$ 100/10 $H_2$ | 6" | 6978 | 6069 | 6602 | 47–49 | 18–22 |

[1]Material A is blend of 15% aluminum clad nickel, 7% prealloyed 80 Ni 20 Cr, and 78% self-fluxing alloy-(2.5 Si, 10.0 Cr - 2.5 B - 2.5 Fe, 0.15 C - bal. Ni).
[2]Material B is 90% aluminum (8%) clad self-fluxing alloy of the invention (2.5 Si, 10.0 Cr, 2.5 B, 2.5 Fe, 0.15 C-bal. Ni) blended with 10% 9 Al 8 Mo clad Ni (Example 2)
[3]Page 3 of METCO Research Lab Report No. 106 - Evaluation Methods and Equipment for Flame Sprayed Coatings.
[4]Page 5 of METCO Research Lab Report No. 106 - Evaluation Methods and Equipment for Flame Sprayed Coatings.
[5]AA arithmetical average as measured by Model 21 Profilometer Type V motor trace at tracing speed of 0.30" per. sec.

The data above shows that Material B containing the clad self-fluxing alloy is a superior flame spray material to Material A which contained a clad material but no clad self-fluxing alloy. The coatings provided by the aluminum clad self-fluxing alloy of the invention are hard, grindable and durable as well as self-bonding.

EXAMPLE 3

When 50% of the 90% composite aluminum self-fluxing alloy with 10% composite aluminum-molybdenum-nickel powder was admixed (blended) with 50% refractory molybdenum metal powder, and sprayed per Example 1, a hard, grindable, wear resisting coating was produced. (See U.S. Pat. No. 3,313,633, Example 5 – 50% molybdenum). The coating hardness was Rc 35–40, and bond strength was 5,027 psi.

EXAMPLE 4

When 50% of the 90% composite aluminum self-fluxing alloy with 10% composite aluminum-molybdenum-nickel powder is admixed (blended) with 50% of a refractory tungsten carbide powder (See U.S. Pat. No. 3,305,326 Example 3-crystalline carbide), a hard grindable coating was produced, with Rc hardness of 53–55, and a bond strength of 6,444 psi.

EXAMPLE 5

Repeating Example 4 using 50% of the composite powder of Example 1 (without the addition of the aluminum-molybdenum-nickel powder) produces similar results.

EXAMPLE 6

A self-fluxing alloy powder comprising −170 +325 mesh particles of the same composition as in Example 1, was mixed in proportion 9.6 kg with 1.4 kg of a phenolic varnish having approximately 10% solid contents. A blend of a 50/50 proportion of −10 micron aluminum and −10 micron molybdenum powders was prepared, and 1.7 kg of this blend was mixed with the self-fluxing alloy. The powders were warmed while blending and dried at about 250° F. The resulting composite powder was screened to −100 mesh +325 mesh, and primarily comprised self-fluxing alloy core particles clad with about 7½% each of aluminum and molybdenum.

The powder was sprayed with a METCO 5P gun using parameters given in Table IV. Results were similar to those given for the material of Example 2, i.e., Material B in Table V.

EXAMPLE 7

The powder of Example 1 is blended with 7% of nickel chromium alloy powder containing 20% chromium and size −140 +325 mesh. Flame spraying is conducted in a similar manner to Example 6 above. The coating results are similar to Example 6 except that the coating has less of a thickness limitation but is only slightly lower in bond strength, hardness and wear resistance.

EXAMPLE 8

A blend or physical mixture of a powder comprising the same self-fluxing alloy described in Example 1 above was made containing 5% coarse aluminum powder (Metco 54, −170 +325 mesh). This material was a blend, i.e, the aluminum powder was only physically mixed with the self-fluxing alloy and did not coat the surface. A true blend or physical mixture was provided of the type disclosed in U.S. Pat. No. 2,936,229.

EXAMPLE 9

A second blend similar to the blend of Example 8 was made from the same self-fluxing alloy of Example 1 and fine aluminum powder of mesh size −325. The components of this physical mixture were the same metal powder constituents of Example 1 including the fine aluminum material. The fine aluminum did not coat the self-fluxing alloy but was present as a simple physical mixture with the aluminum present as discrete particles separate from the particles of self-fluxing alloy. The proportion of aluminum in this blend was the same as in the clad powder of Example 1, i.e., 6% based upon the weight of the total metal.

EXAMPLE 10

A blend similar to that of Example 4 of U.S. Pat. No. 2,936,229 was prepared. The same contained 2% by weight of Metco 54 aluminum powder and −120 +325 mesh self-fluxing alloy No. 2, the latter composition comprising 0.2 weight percent carbon, 4 weight percent silicon, 4 weight percent boron, 5 weight percent molybdenum and a maximum of 3 weight iron. It also contained 5.5 weight percent copper, 16 weight percent chromium, a maximum of 1% cobalt, the balance being nickel.

The materials of Examples 1, 8, 9 and 10 were each independently sprayed onto a cold rolled steel employing a combustion flame spraying gun known as the Metco 5P gun. The spray parameters were as set forth in Table IV above. All materials were sprayed onto the panels of cold rolled steel which had been prepared only by cleaning with emery paper. At 8 mills thickness, only the clad powder of Example 1 adhered to the surface and, therefore, was self-bonding. The blends of Examples 8, 9 and 10 did not adhere to the cold rolled steel.

The materials of Example 1, 8, 9 and 10 were sprayed on steel panels prepared by rough grit blasting to obtain normally bonded coatings for further tests. They were surface ground with a 60-grit silicon carbide wheel and a Rockwell hardness measurement was taken. The test details are as reported in the footnote to Table V above. The results are as follows:

| Coating | Surface Roughness "AA | Hardness Rc |
|---|---|---|
| Example 1 | 10–20 | 37 |
| Example 8 | 20–40 | 20 |
| Example 9 | 15–35 | 20 |
| Example 10 | 70–150 | 29 |

It was observed that when the coating coated sheet material was bent, the coatings provided by the blended material did not adhere to the substrate and became dislodged therefrom. On the contrary, the coating provided by the clad material adhered to the substrate such that it was not removed during the bending operation. The coating provided by the clad material of Example 1 could be ground to a final smooth surface.

The aluminum clad self-fluxing alloys of the present invention are characterized by providing a coating when flame sprayed under the conditions of Example 1, Tble IV, for a Metco "5P" ThermoSpray Gun having the following characteristics:

| | | Preferred Range |
|---|---|---|
| Hardness RC | Minimum 25 | 30–50 |
| Surface Finish (with 60 grit SiC) | Maximum 30 $\mu$"AA | 8–25 |
| Bond Strength | Minimum 2400 psi | 3000–7000 |
| Grindability | Very good | Excellent |
| Wear Resistance | At least as good as material A of Table V | |

It will be appreciated that the instant specification and examples are set forth by way of illustration and not limitation, and that various modifications and changes may be made without departing from the spirit and scope of the present invention.

What is claimed is:

1. A flame spray powder material in the form of a composite suitable for flame spraying formed of at least two metal components, said material comprising:
   a. a first core powder component, which core component consists essentially of a self-fluxing alloy which consists essentially of at least about 40% of its weight of nickel or cobalt and about 1 to 6% by weight boron, and
   b. a coating component of fine aluminum powder on said core, which powder coating is held to said core by a binder, the core component being present in an amount of about 66 to 99% by weight of the combined weight of the first and second components, said component being in the form of a structurally integral unit where each particle of core component has bonded thereto the coating component, said spray material additionally containing in the form of a blend therewith up to about 20% by weight of a third component comprising nickel.

2. A flame spray material according to claim 1 wherein the first component comprises a positive amount of at least one additive selected from the group consisting of silicon, chromium, copper, molybdenum, aluminum, iron, carbon and tungsten said additive being present to the extent of up to about 6% of silicon, up to about 20% of chromium, up to about 8% of copper, up to about 10% of molybdenum, up to about 5% of aluminum, up to about 8% iron, up to about 2% carbon and up to about 20% tungsten.

3. A flame spray material according to claim 2 wherein the first component comprises about 85 to 97% of the combined weights of the first and second components, said first component containing at least about 60% by weight of nickel or cobalt.

4. A flame spray material according to claim 1 wherein said binder is a varnish.

5. A flame spray material according to claim 1 wherein the first component comprises about 85 to 97% of the combined weights of the first and second components, said first component containing at least about 60% by weight of nickel and cobalt.

6. A flame spray material according to claim 1 wherein said third component has a composition within the following ranges:

| | |
|---|---|
| Nickel | 66–97.5 weight percent |
| Aluminum | 2–18 weight percent |
| Molybdenum | 0–16 weight percent. |

7. A flame spray material according to claim 6 wherein the nickel of the third component is present in the form of a clad material wherein aluminum powder clads a nickel core, the nickel core comprising about 66 to 97.5% by weight of the third component.

8. A flame spray material according to claim 7 wherein the aluminum coating of the third component additionally contains molybdenum.

9. A flame spray material according to claim 8 wherein the nickel, aluminum and molybdenum of the third component are within the following ranges:

| | |
|---|---|
| Nickel | 80–92 weight percent |
| Aluminum | 4–10 weight percent |
| Molybdenum | 4–10 weight percent, |

the sum of the weights of nickel, aluminum and molybdenum of the third component equaling 100% by weight of the weight of the third component.

10. A flame spray material according to claim 5 in the form of a blend with up to about an equal weight of a metal carbide or molybdenum.

11. A flame spray material according to claim 6 further blended with up to about an equal weight of a metal carbide.

12. A flame-spray material according to claim 2 wherein said coating component comprises an aluminum in the amount of 1–34 weight percent, up to 10 weight percent silicon, up to 16 weight percent molybdenum, up to 3 weight percent boron and up to 20 weight percent iron.

13. A flame-spray material according to claim 12 comprising 3–15 weight percent aluminum, up to 10 weight percent silicon, up to 10 weight percent molybdenum, up to 2 weight percent boron and up to 15 weight percent iron.

14. A flame-spray material according to claim 13 wherein the coating comprises 5–10 weight percent aluminum, up to 10 weight percent silicon and up to 12% iron.

15. A flame-spray material according to claim 12 additionally containing a third component having the following composition:

| | |
|---|---|
| Nickel | 80–92 weight percent |
| Aluminum | 4–10 weight percent |
| Molybdenum | 4–10 weight percent, |

the sum of the weight of nickel, aluminum and molybdenum of the third component equaling 100% by weight of the weight of the third component.

16. A flame-spray material according to claim 12 additionally containing in the form of a blend therewith up to 20% by weight of a third component comprising nickel.

17. A flame-spray material according to claim 16 wherein said third component has a composition within the following range:

| | |
|---|---|
| Nickel | 66–97.5 weight percent |
| Aluminum | 2–18 weight percent |
| Molybdenum | 0–16 weight percent. |

18. A flame-spray material in the form of a blend, said blend comprising:

a. a first composite which first composite is in a form suitable for flame-spraying and is formed of at least two metal components which react exothermically with each other when melted forming an intermediate compound which first composite consists essentially of:

1. as a first component in an alloy consisting essentially of at least about 40% of its weight of at least one of nickel and cobalt, and about 1 to 6% by weight of boron; and
2. a second component consisting essentially of aluminum powder, the first component being present in about 66 to 99% of the combined weight of the first and second components, said first composite being in the form of a structurally integral unit wherein the components of the first component have affixed thereto components of the second component; the first component comprises a positive amount of at least one additive selected from the group consisting of silicon, chromium, copper, molybdenum and aluminum which additive is present to the extent of:

up to about 6% silicon,
up to about 20% of chromium,
up to about 8% of copper,
up to about 10% of molybdenum, and
up to about 5% of aluminum, the second component being secured to the first component by a varnish and the second components being on the first component in the form of a coating on a core; and b. 5 to 15% by weight of a second composite consisting essentially of about 2 to 18% by weight of aluminum, about 0.5 to 16% by weight of molybdenum and about 66 to 97.5% by weight of nickel, the nickel being present as a powder and having the aluminum and molybdenum secured thereto by a varnish, said first composite being in the form of a grain of the individual components of said first and second components.

19. A powder blend according to claim 18 further blending it up to about an equal weight of a metal carbide.

20. A powder blend according to claim 18 further blending it up to about an equal weight of molybdenum.

21. In a process of flame spraying a substrate wherein a material to be sprayed is passed into a flame, the improvement which comprises employing as the flame spray material the powder of claim 1.

22. In a process of flame spraying a substrate wherein a material to be sprayed is passed into a flame, the improvement which comprises employing as the flame spray material the powder of claim 2.

23. In a process of flame spraying a substrate wherein a material to be sprayed is passed into a flame, the improvement which comprises employing as the flame spray material the powder of claim 5.

24. In a process of flame spraying a substrate wherein a material to be sprayed is passed into a flame, the improvement which comprises employing as the flame spray material the powder of claim 6.

25. In a process of flame spraying a substrate wherein a material to be sprayed is passed into a flame, the improvement which comprises employing as the flame spray material the powder of claim 9.

26. A coated metallic article prepared by plasma flame spraying a powder material in the form of a composite suitable for flame spraying formed of at least two metallic components, said composite characterized by:

a. a first core powder component, which core component consists essentially of a self-fluxing alloy which consists essentially of at least about 40% of its weight of nickel or cobalt and about 1 to 6% by weight boron, and b. a coating component of fine aluminum powder on said core, which powder coating is held to said core by a binder, the core component being present in an amount of about 66 to 99% by weight of the combined weight of the first and second components, said component being in the form of a structurally integral unit where each particle of core component has bonded thereto the coating compound, said coated article having a grindable surface whose hardness is at least 25 on the Rc scale, whose surface finish with 60 grit SiC is a maximum of 30 $\mu$ ''AA, and whose bond strength to the substrate is at least 2400 psi.

c. said spray material additionally containing in the form of a blend therewith up to about 20% by weight of a third component comprising nickel.

* * * * *

UNITED STATES PATENT AND TRADEMARK OFFICE

CERTIFICATE OF CORRECTION

PATENT NO. : 4,019,875

DATED : April 26, 1977

INVENTOR(S) : Ferdinand J. Dittrich et al

It is certified that error appears in the above-identified patent and that said Letters Patent are hereby corrected as shown below:

Column 8, line 3, "2 to 18" should read -- 2 to 18% --.

Column 12, line 37, "Tble" should read -- Table --.

Column 13, line 66 (Claim 12, line 2), delete "an" before "aluminum".

Signed and Sealed this

First Day of November 1977

[SEAL]

*Attest:*

RUTH C. MASON
*Attesting Officer*

LUTRELLE F. PARKER
*Acting Commissioner of Patents and Trademarks*